US006102098A

United States Patent [19]

Randazzo

[11] Patent Number: 6,102,098

[45] Date of Patent: Aug. 15, 2000

[54] HAND HELD POSTAGE STAMP APPLICATOR

[75] Inventor: Anthony Joseph Randazzo, Chalmette, La.

[73] Assignee: Anthony J. Randazzo, Chalmette, La.

[21] Appl. No.: 09/174,744

[22] Filed: Oct. 19, 1998

[51] Int. Cl.[7] ..... B65C 11/00

[52] U.S. Cl. ..... 156/577; 156/579

[58] Field of Search ..... 156/344, 577, 156/579, 584

[56] References Cited

U.S. PATENT DOCUMENTS

| | | | |
|---|---|---|---|
| 1,835,817 | 12/1931 | Skolnik | 156/442 |
| 3,051,353 | 8/1962 | Krueger | 156/577 X |
| 3,101,282 | 8/1963 | Glassco et al. | 118/40 |
| 3,123,513 | 3/1964 | Synder | 156/522 |
| 3,238,083 | 3/1966 | Snyder | 156/522 |
| 3,736,212 | 5/1973 | Fedrick | 156/517 |
| 3,764,439 | 10/1973 | Rome | 156/442 |
| 3,821,057 | 6/1974 | Grasmann | 156/384 |
| 3,951,726 | 4/1976 | Found | 156/577 X |
| 4,008,119 | 2/1977 | Hermann | 156/577 X |
| 4,274,906 | 6/1981 | Clar | 156/584 X |

*Primary Examiner*—Mark A. Osele

[57] ABSTRACT

A hand held stamp dispenser and applicator that feeds pressure sensitive stamps (self-sticking stamps on a backing tape) from a roll. The hand held stamp dispenser and applicator incrementally indexes each stamp by depressing and releasing a manually operated lever press pad. When the lever press pad is depressed three things occur with each press or squeeze that has effect on the dispensing and the application. First, a gear is rotated turning a mandrel to draw the stamp string through a feed channel, thereby, incrementally dispensing a stamp and automatically pealing off the backing tape and exposing the pressure sensitive adhesive. Second, prior to reaching the bottom of the press pad stop point, a latching pawl drops into a gear cog to prevent reversing of the gear and mandrel. Third, a brake pad coupled to the lever press pad bottoms out and presses on the stamp and backing tape in a feed channel locking the stamp string in place so that the stamp can be applied or taken without pulling on the roll of stamps.

20 Claims, 3 Drawing Sheets

HAND HELD POSTAGE STAMP APPLICATOR

BACKGROUND OF THE INVENTION

1. Field of the Invention

The invention relates to a novel stamp dispenser and applicator.

2. Background Art

Stamp dispensers are not new. By and Large these devices are large and heavy and require many parts to function and do not lend to the variations previously mentioned.

SUMMARY OF THE INVENTION

The concept of the hand held postage stamp applicator is that of a newly designed novel device to automatically apply a stamp to an envelope. Specifically, the device would be an automatic dispenser machine that would allow a person to quickly and easily apply a pressure sensitive adhesive backed stamp from a roll of stamps onto an envelope or package.

What is provided is a hand held stamp dispenser and applicator that presents a means to feed pressure sensitive (self-sticking stamps on a backing tape) from a roll. These stamps are perforated adjacent to each other on the roll. The hand held stamp dispenser and applicator is a very simple device with a sturdy comfortable handle which can be used to dispense one stamp at a time while automatically removing the backing tape and presenting the stamp ready to apply on the envelope or package. This is done by incrementally indexing each stamp by depressing and releasing a manually operated lever pad. When the lever pad is depressed three things occur with each press or squeeze that has effect on the dispensing and the application. First, the gear is rotated turning the mandrel to draw the stamp string through the feed channel, thereby, incrementally dispensing a stamp and automatically pealing off the backing tape and exposing the pressure sensitive adhesive. To position the stamp exactly may take two to three press and releases. As the mandrel becomes larger in diameter with tape, less press and releasing is required. Second, prior to reaching the bottom of the press pad stop point, the latching pawl drops into the gear cog to prevent reversing of the gear and mandrel. Third, the brake pad bottoms out and presses on the stamp and tape, locking the stamp string in place so that the stamp can be applied or taken without pulling on the roll of stamps in the magazine.

An object of the present invention is that the hand held postage stamp dispenser and applicator offers many possibilities for embellishment with useful devices such as clocks, company logo, club crests, checkering and engraving. It can be inexpensively fabricated from many kinds of materials and combination of materials to be used by people who mail letters or packages.

Broadly, the hand held postage stamp dispenser and applicator is designed to be easy to fabricate and has only four moving parts and three simple springs, one (1) compression coil spring and two (2) simple flat springs.

A further object of the present invention is to provide a hand held postage stamp dispenser and applicator which can be inexpensively fabricated from many kinds of materials and combination of materials to be used by people who mail letters or packages.

A feature of the present invention is that the hand held postage stamp dispenser and applicator is very simple to operate and use.

Another feature of the present invention is to provide a hand held postage stamp dispenser and applicator which is very light in weight and varies with materials used.

It is a still further feature of the present invention to provide a hand held postage stamp dispenser and applicator which is easy to handle and use, very simple to manufacture, as well as, lending to aesthetics which can lend to its being offered as a gift of value and pleasure, for example, as an executive gift or special person gift.

A still further feature of the present invention is that the hand held postage stamp dispenser and applicator allows for the application of stamps with one hand.

An advantage of the present invention is that the hand held postage stamp dispenser and applicator could be useful even for individuals who have limited manual dexterity.

The advantages, features, benefits and objectives of this invention will be more apparent with the detailed description given in conjunction with the drawings and mechanical description.

BRIEF DESCRIPTION OF THE SEVERAL VIEWS OF THE DRAWINGS

For a further understanding of the nature and objects of the present invention, reference should be had to the following description taken in conjunction with the accompanying drawings in which like parts are given like reference numerals and, wherein.

DESCRIPTION OF THE INVENTION

Figure 1:
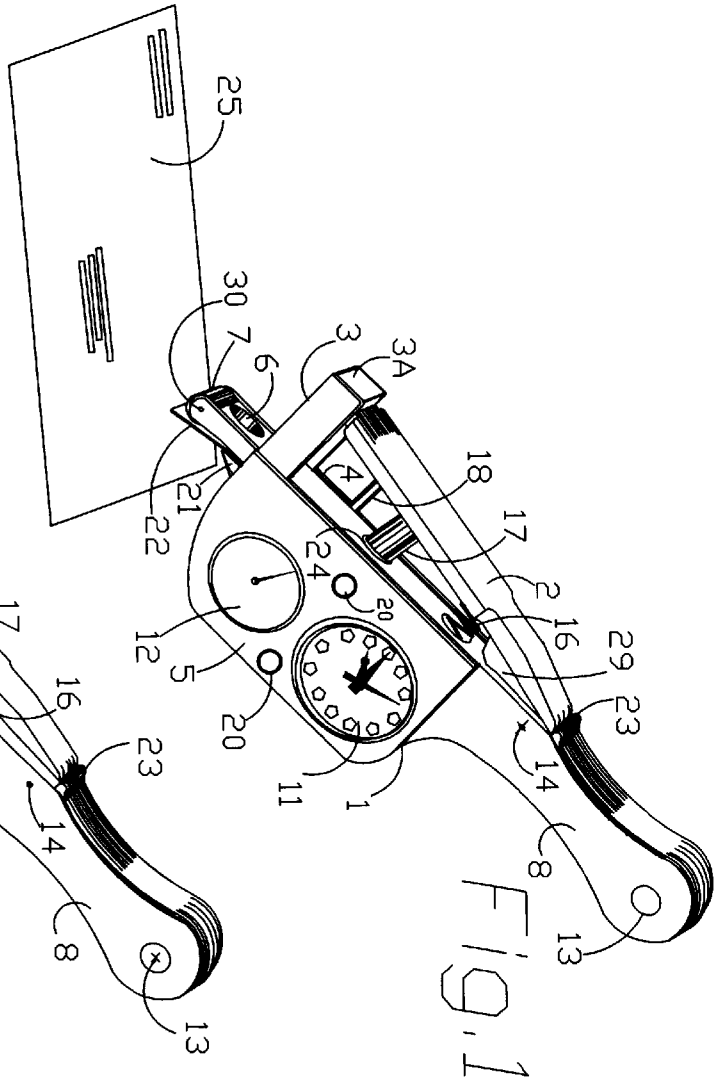
FIG. 1 is a perspective view that shows the hand held stamp dispenser and applicator in a position normally held in hand ready to apply the stamp.

Referring now to FIG. 1, FIG. 1 is a perspective view that shows the a hand held postage stamp dispenser and applicator in a position normally held in hand ready to apply the stamp 22. The stamp 22 is separated from its backing tape 26 with adhesive exposed and ready to be applied to the envelope 25. To get to that point the lever press pad 2 was previously depressed and released two or three times and then holding the press pad 2 down to apply the stamp as shown in FIG. 2.

Figure 2:
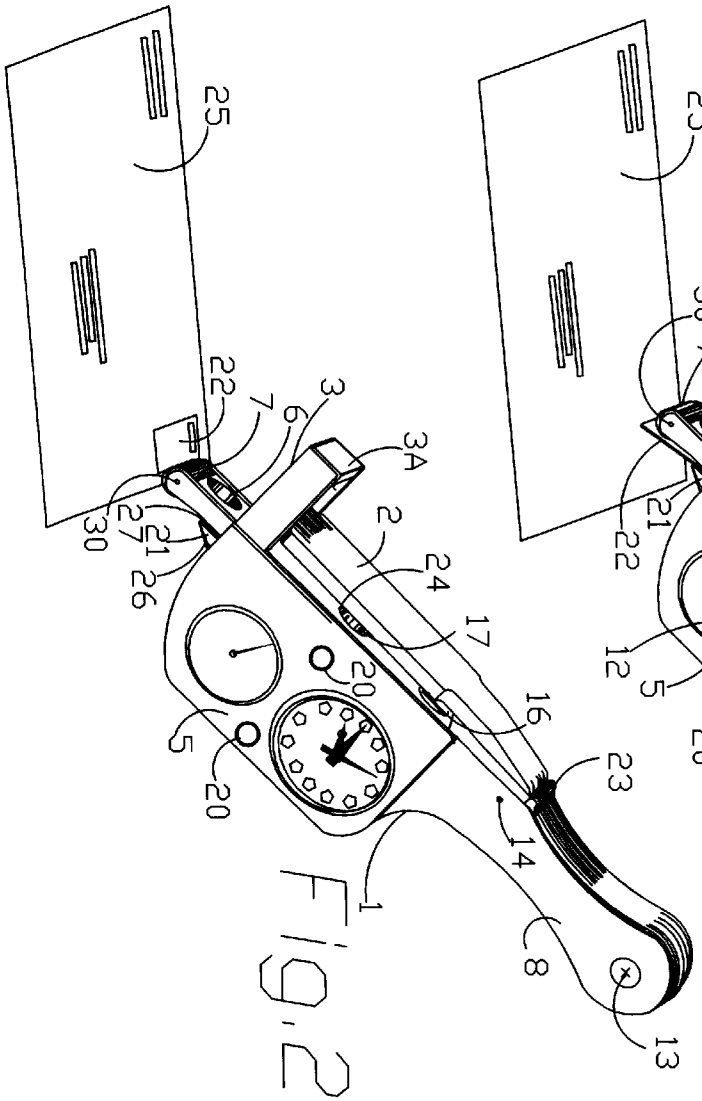
FIG. 2 is a perspective view which continues the stamp application to the envelope showing the hand held stamp dispenser and applicator with the press pad held down, locking the stamps in the feed channel in place, while the stamp is touched on the envelope and easily taken from the applicator.

Referring now to FIG. 2, FIG. 2 is a perspective view which continues the stamp application to the envelope 25 showing the applicator with the press pad 2 held down, locking the stamps 22 in the feed channel 19 in place, while the stamp 22 is touched on the envelope 25 and easily taken from the applicator. The roller 7 has been passed on the stamp 22 and the application is finished. The press pad 2, brake action can be released, as soon as, the stamp disengages the stamp string 27.

Figure 3:
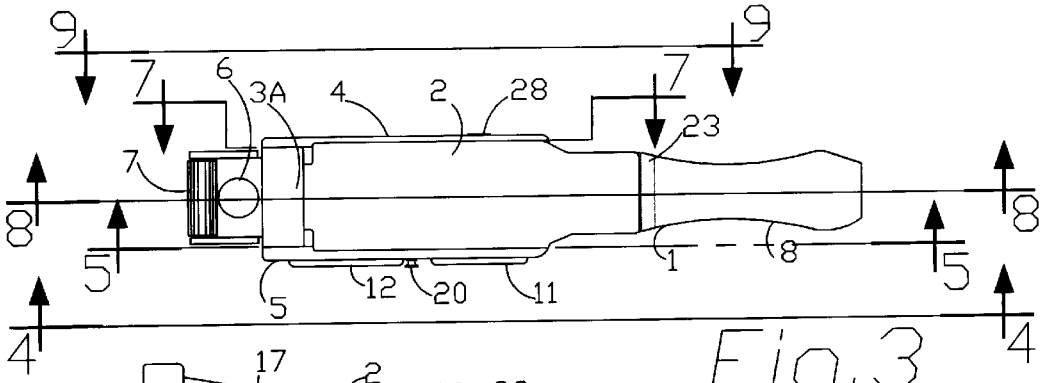
FIG. 3 is a plan view that indicates the sections and views that are shown in FIGS. 4, 5, 7, 8 and 9.
Figure 4:
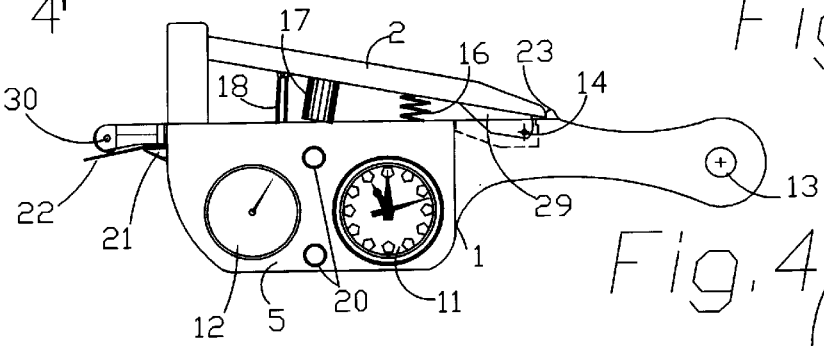
FIG. 4 is a view taken about line 4—4 in FIG. 3 showing the right side view of the hand held postage stamp dispenser and applicator with the stamp not quite free from its backing tape and the press pad released.

Referring now to FIG. 4, FIG. 4 is a view taken about line 4—4 in FIG. 3 showing the right side view of the hand held stamp dispenser and applicator with the stamp 22 not quite free from its backing tape 26 and the press pad 2 released.

Figure 6:
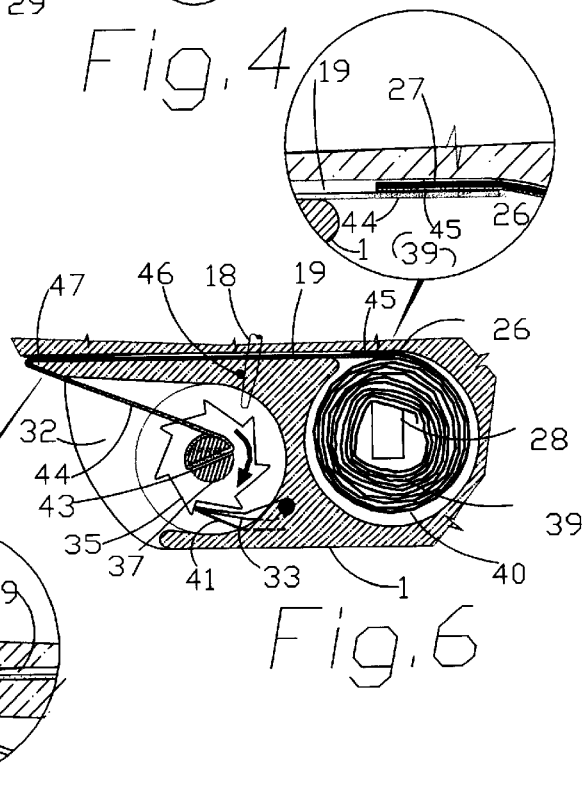
FIG. 6 is a sectional view taken about line 6—6 in FIG. 11.
Figure 11:
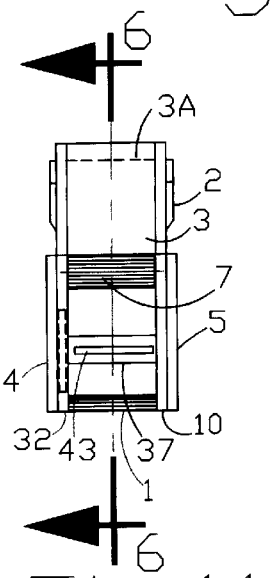
FIG. 11 is a front view of the a hand held postage stamp dispenser and applicator taken about line 11—11 of FIG. 9.

Referring now to FIG. 6, FIG. 6 is a sectional view taken about line 6—6 in FIG. 11. This section is cut through center to expose mechanism, tongue leader 44 and connection of leader 44 to the new roll 40 of stamps. The hand held stamp dispenser and applicator allows the dispensing of the stamp 22 to proceed without having to physically remove any stamps from the roll/stamp string to thread the backing tape 26 onto the mandrel 37.

Figure 7:
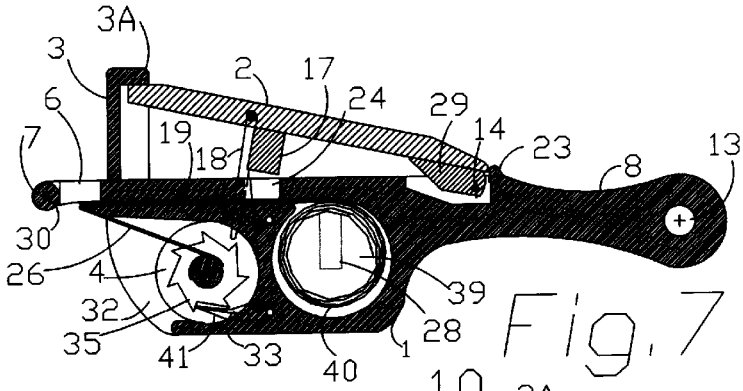
FIG. 7 is a sectional view taken along line 7—7 of FIG. 3.

Referring now to FIG. 7, FIG. 7 is a sectional view taken along line 7—7 of FIG. 3. It shows a section down the longitudinal center of the hand held stamp dispenser and applicator. The press pad 2 is shown in the released position.

Figure 8:
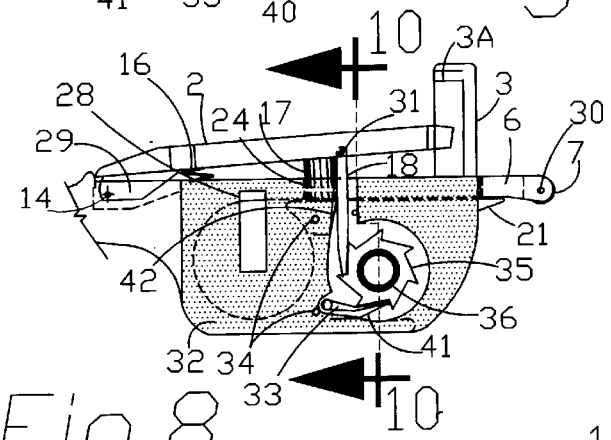
FIG. 8 is a view taken about line 8—8 of FIG. 3.

Referring now to FIG. 8, FIG. 8 is a view taken about line 8—8 of FIG. 3. This is a left side view with the side plate 5 of the left bearing housing removed, exposing the left side spacer plate, ratchet gear 35 and ratchet push rod 18. The ratchet push rod 18 is connected to the press pad 2 and will incrementally rotate the ratchet gear one tooth with each actuation of the press pad 2. The press pad 2 is shown in the depressed position.

Figure 9:
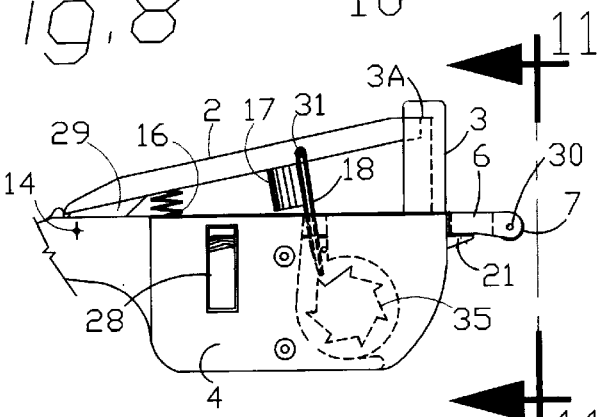
FIG. 9 is a view taken along line 9—9 of FIG. 3.

Referring now to FIG. 9, FIG. 9 is a view taken along line 9—9 of FIG. 3. This is a left side view with the non-removable cover (gear side bearing housing 4) in place and showing the stamp gauge window 28. The gauge window 28 displays the approximate number of stamps left in the magazine 39 for use.

Figure 10:
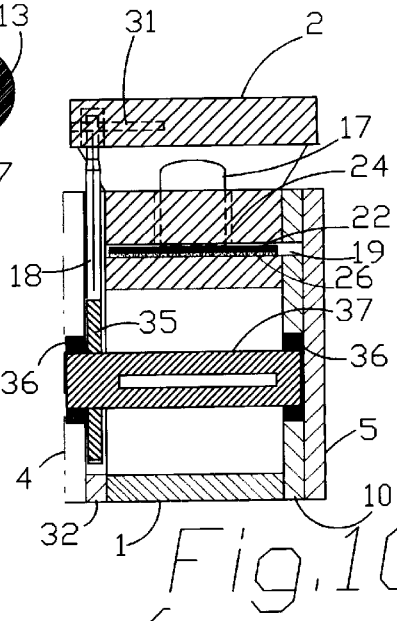
FIG. 10 is a sectional view taken about line 10—10 of FIG. 8.

Referring now to FIG. 10, FIG. 10 is a sectional view taken about line 10—10 of FIG. 8. It shows a cross section of the hand held stamp dispenser and applicator with the press pad 2 depressed and the brake pad 17 pressed on the stamp string 27 in the feed channel 19. This feature locks the stamp string 27 in place during application of a stamp 22 to the envelope 25. This sectional view also shows detail of the mandrel 37 and bearings 36.

Referring now to FIG. 11, FIG. 11 is a front view of the hand held stamp dispenser and applicator taken about line 11—11 of FIG. 9.

The hand held postage stamp dispenser and applicator would consist of the following interrelated components: a main body 1 and handle 8 (made from one piece of material), lever press pad 2, lever pad hinge 29, compression spring 16 for lever press pad 2, lever pad hinge pin 14, ratchet push rod 18, ratchet rod spring 42, ratchet rod slide bearing pin 46, ratchet pawl 33, ratchet gear 35, and mandrel 37, press roll assembly having roller 7 (optional—a fixed skid would work as well), gear side housing and spacer plate 32, gear side bearing housing 4, stamp brake 17, removable side plate 5 for stamp roll 40, refillable magazine 39, mandrel bearing housing and spacer 10, ratchet pawl unlatching lever 34 (the ratchet pawl and the unlatching lever can be fabricated from one piece of material), (two) mandrel shaft bearings 36 (one for each side) and miscellaneous screws and fasteners.

The hand held stamp dispenser and applicator could be designed utilizing a dual ratchet gear and rod assembly (having a ratchet gear and rod on each side of the mandrel) if deemed necessary for smooth operation.

In operation, a roll of self-stick stamps 40 is placed in the magazine 39 and threaded through the feed channel 19 with the use of the tongue leader 44, which remains attached to the mandrel 37 by having approximately four (4) wraps always remaining to hold the beginning of the tongue leader 44 in the mandrel slot 43. (See FIG. 6 for a sectional view of this procedure.) In FIG. 6 the top end of the roll of stamps 40 is held out beside the magazine 39 to attach to the backing tape 26 of the lead stamp to the tongue leader 44 by means of the fixed adhesive on the tongue leader 44. Then place the roll of stamps 40 into the magazine 39 and thread the tongue leader 44 with the attached stamp roll tape 26 into the feed channel 19. There will be some loose tongue leader 44 remaining outside the feed channel discharge 21. Next, index the tongue leader 44 onto the mandrel 37 by depressing and releasing the press pad 2 until the lead stamp reaches the feed channel discharge 21. Now the hand held stamp dispenser and applicator is ready for applying stamps 22 to the envelope 25 or package. The view shows the roll of stamps 40 in the magazine 39, backing tape 26 and tongue leader 44 joined by the adhesive 45 and placed in the feed channel 19.

When replacing a roll of stamps 40, the expended tape 26 is wrapped on the mandrel 37 and should be removed to make room for the new roll of stamps 40. To do this, the backing tape 26 is pulled off the mandrel 37 by hand while holding the pawl unlatching lever 34 to unlatch the anti-reverse feature of the ratchet gear 35 to allow the backing tape 26 to unroll off the mandrel 37 until the tongue leader 44 is reached and extending enough to be attached to the new roll of stamps 40 as previously stated. The expended backing tape 26 can be removed from the reusable adhesive 45 (i.e. double side tape) and attach it to feed the new roll of stamps 40 through the hand held postage stamp dispenser and applicator.

To dispense and apply a stamp 22 to an envelope 25, the lever press pad 2 is manually depressed and the lever press pad 2 pushes the ratchet push rod 18 downward against ratchet gear tooth to rotate the mandrel 37. When the mandrel 37 rotates it winds the tongue leader 44 or the stamp backing strip on the mandrel 37, thereby pulling the stamps forward, but will peel the backing tape 26 away as it reaches the feed channel discharge 21 as the backing tape 26 reverses direction toward the mandrel 37. A bottom mounted pawl 33 and spring 41 will engage in a cog of the ratchet gear 35 as it advances to prevent the mandrel 37 from reversing rotation. (The ratcheting mechanism could be designed to rotate the mandrel 37 in either direction to be determined by manufacturer.) The pawl unlatching lever 34 would allow the pawl 33 to be disengaged from the ratchet gear 35 so as to allow the expended backing tape 26 off the mandrel 37 when changing rolls of stamps 40. The feed is driven by the lever press pad 2 which is pressed and released by thumb or index finger to incrementally ratchet index each stamp 22 to the correct position for application. The stamp 22 is then pressed onto the envelope 25 or package.

The main body 1 of the device could be fabricated from wood, metal, plastic or a combination thereof. For example, some models may be made of cherry wood stained and finished with brass sides, gear indexing mechanisms and accents.

Figure 5:
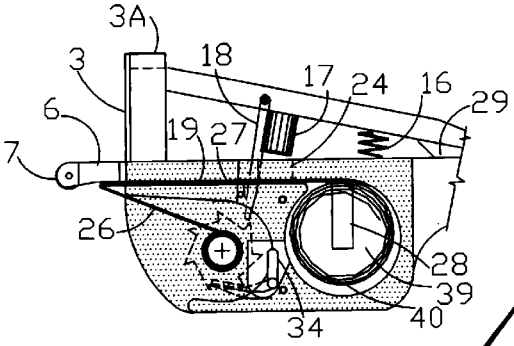
FIG. 5 is a view taken about line 5—5 in FIG. 3 showing the pawl unlatching lever and the magazine for the roll of stamps.

In use, the user would simply load a roll of stamps 40 into the magazine 39 through a side mounted hinged door with latch or a removable side plate 5. To open the hinged door with latch, simply pull upper knob 20 or remove the removable side plate 5 by unscrewing two knurled knob screws and remove the side plate 5. On this side plate 5, is shown mounted a clock 11 and possibly a thermometer 12 or similar. When a new stamp roll 40 is attached to the tongue leader 44 and threaded as previously explained, the hand held postage stamp dispenser and applicator is ready to dispense a stamp 22 by depressing and releasing the press pad 2 spring returned by spring 16. The press pad 2 is hinged to the body 1 by a hinge 29 and hinge pin 14. The press pad 2 pivots on this hinge pin 14 to drive the ratchet push rod 18. The ratchet push rod 18 pivots on a pin 31 that joins it to the press pad 2. As the ratchet push rod 18 moves to rotate the ratchet gear 35 it slides on a bearing pin 46. When released the press pad 2 is returned to the upper stop 3*a* by compression spring 16. When the press pad 2 returns, it raises the ratchet push rod 18 again and is returned to the home position pressing on the bearing pin 46 positioned by spring 42. When the press pad 2 is depressed it bottoms out by pressing the brake pad 17 on the stamp string 27 in the feed channel 19. (See FIGS. 5, 6 and 10.) The press pad guide 3 holds the press pad 2 in proper alignment and provides the upper stop 3*a* for the press pad 2.

As the press pad 2 is pressed and released the stamps 22 are pull through the feed channel 19 where the stamps 22 with the backing tape 26 pass through a flattening gauge 47 to assure the individual stamp 22 is dispensed properly for easy application. When the stamp 22 is applied to the envelope 25, it is pressed for perfect application by the press roller 7, that turns on the press roll shaft 30. A skid, requiring no moving parts, rather than the roller 7, shaped similar to the roller 7 can be used here. It would be part of the body 1. The handle 8, has a hole 13 in it for parking by hanging on a peg. The hole 13 in the handle 8 can be used for adornments like initial crests, etc. The handle 8 is also part and extension of the body 1. Further, on top of the handle 8 is a pinch protection rise 23 that is part of the body 1. The press pad 2 could be lowered deeper into the body 1 to accomplish the same potential pinch point protection.

Viewing hole 6, as best seen in FIGS. 1 and 2, is used to see the stamp therethrough. Moreover, main body 1 has formed therein aperture or orifice 24 to pass therethrough the brake pad 17 to feed channel 19.

In summary, the present invention provides a hand held stamp dispenser and applicator that presents a means to feed pressure sensitive (self-sticking stamps 22 on a backing tape 26) from a roll 40 wherein these stamps 22 are perforated adjacent to each other on the roll 40. The hand held stamp dispenser and applicator is a very simple device with a sturdy comfortable handle 8 which can be used to dispense one stamp 22 at a time while automatically removing the backing tape 26 and presenting the stamp 22 ready to apply on the envelope 25 or package. This is done by incrementally indexing each stamp 22 by depressing and releasing a manually operated lever press pad 2. When the lever press pad 2 is depressed three things occur with each press or squeeze that has effect on the dispensing and the application. First, the gear 35 is rotated turning the mandrel 37 to draw the stamp string 27 through the feed channel 19, thereby, incrementally dispensing a stamp 22 and automatically pealing off the backing tape 22 and exposing the pressure sensitive adhesive. To position the stamp 22 exactly may take two to three press and releases. As the drum (mandrel 37) becomes larger in diameter with backing tape 26, less press and releasing is required. Second, prior to reaching the bottom of the press pad stop point, the pawl 33 drops into the gear cog to prevent reversing of the gear 35 and mandrel 37. Third, the brake pad 17 bottoms out and presses on the stamp and backing tape in the feed channel 19, locking the stamp string 27 in place so that the stamp can be applied or taken without pulling on the roll 40 of stamps in the magazine 39.

The hand held stamp dispenser and applicator is a very handy device for the home, the office, very simple to operate and could be useful even for individuals with limited manual dexterity.

The hand held stamp dispenser and applicator is designed to be easy to fabricate and has only four moving parts and three simple springs, one (1) compression coil spring 16 and two (2) simple flat springs 41 and 42. The present invention is a hand held device with a comfortable handle that can be handled as a point of interest, with not parts to rattle or water to spill, and no base where the envelope must be placed, for example, a pet rock or an executive toy. The present invention offers many possibilities for embellishment with useful devices such as clocks, company logos, club crests, checkering and engraving. It can be inexpensively fabricated from many kinds of materials and combination of materials to be used by people who mail letters or packages.

After describing my invention I claim:

1. A hand held stamp dispenser and applicator for applying self-stick stamps one at a time from a roll of self-stick stamps with backing tape onto an envelope or package, said hand held stamp dispenser applicator comprising:

(a) a body with a handle for holding the dispenser and applicator;

(b) a magazine within said body for holding said roll of said self-stick stamps with said backing tape;

(c) a feed channel through which said stamps and said backing tape travel after leaving said magazine;

(d) a feed channel discharge where said backing tape is reversed and the individual stamps are peeled therefrom;

(e) a mandrel upon which expended backing tape is wrapped after said individual stamps have been removed therefrom wherein rotation of said mandrel pulls said stamps and said backing tape through said feed channel and past said feed channel discharge;

(f) a ratchet gear associated with said mandrel and having a plurality of ratchet gear teeth;

(g) a manually operated, spring biased lever press pad;

(h) a ratchet rod attached to said lever press pad wherein depression of said lever press pad pushes said ratchet rod downward against one of the ratchet gear teeth thereby rotating said mandrel;

(i) a spring biased latching pawl engaging a tooth of said ratchet gear and preventing reverse rotation of said mandrel; and, (j) brake pad attached to said lever press pad wherein depression of said lever press pad presses said brake pad against the stamps and the backing tape in said feed channel to prevent excess feeding of said backing tape from said magazine during stamp application.

2. The hand held stamp dispenser and applicator of claim 1, wherein said body comprises a side plate having a clock, a thermometer, or logo coupled thereto.

3. The hand held stamp dispenser and applicator of claim 1, wherein said body comprises a removable side plate wherein removal of said removable side plate provides access to said magazine.

4. The hand held stamp dispenser and applicator of claim 1, wherein said body comprises a side having a stamp gauge window formed therein to permit viewing in said magazine.

5. The hand held stamp dispenser and applicator of claim 1, further comprising a press roll assembly having a roller wherein when said stamp is applied to said envelope, said stamp is pressed by said roller.

6. The hand held stamp dispenser and applicator of claim 1, further comprising a tongue leader which is attached to said mandrel via a mandrel slot and wherein said tongue leader is adapted to be joined to said backing tape.

7. The hand held stamp dispenser and applicator of claim 1, wherein said body comprises an aperture formed therein wherein when said lever press pad is depressed said brake pad passes through said aperture to said feed channel to press against said stamps and said backing tape.

8. A hand held stamp dispenser and applicator for applying self-stick stamps from a roll of self-stick stamps with backing tape onto an envelope or package, said hand held stamp dispenser and applicator comprising:

(a) a body having
  (i) a feed channel to pass therethrough a string of said stamps with said backing tape of said roll, and
  (ii) a feed channel discharge at the end of said feed channel where said backing tape is reversed and individual stamps are peeled therefrom;

(b) a manually operated, spring biased lever pad hingedly coupled to said body;

(c) a brake pad attached to an underside of said lever pad wherein depression of said lever pad presses said brake pad against said string of said stamps with said backing tape in said feed channel; and, (d) a mandrel coupled in said body wherein expended reversed backing tape is wrapped after said individual stamps have been removed therefrom wherein rotation of the mandrel pulls said stamps and said backing tape through the feed channel and past said feed channel discharge.

9. The hand held stamp dispenser and applicator of claim 8, further comprising:

(e) a ratchet gear associated with said mandrel;

(f) a ratchet push rod coupled to said spring biased lever pad and said ratchet gear; and, (g) a ratchet pawl wherein when said spring biased lever pad reaches a stop point, said ratchet pawl drops into a gear cog to prevent reversing of said ratchet gear and said mandrel.

10. The hand held stamp dispenser and applicator of claim 8, wherein said body comprises a side plate having a clock, a thermometer, or logo coupled thereto.

11. The hand held stamp dispenser and applicator of claim 8, wherein said body comprises a removable side plate wherein removal of said removable side plate provides access to said magazine.

12. The hand held stamp dispenser and applicator of claim 8, wherein said body comprises a side having a stamp gauge window formed therein to permit viewing in said magazine.

13. The hand held stamp dispenser and applicator of claim 8, further comprising a press roll assembly having a roller wherein when said stamp is applied to said envelope or said package, said stamp is pressed by said roller.

14. The hand held stamp dispenser and applicator of claim 8, further comprising a tongue leader which is attached to said mandrel via a mandrel slot and wherein said tongue leader is adapted to be joined to said backing tape.

15. The hand held stamp dispenser and applicator of claim 8, further comprising a handle coupled to said body.

16. A hand held stamp dispenser and applicator for incrementally indexing each self-sticking stamp of a stamp roll wherein said stamp roll further includes backing tape, said hand held stamp dispenser and applicator comprising:

(a) a manually operated, spring biased lever press pad adapted to be depressed and released;

(b) a feed channel for passing therethrough a string of said stamps and having a feed channel discharge where said backing tape is reversed in direction;

(c) a brake pad coupled to said lever press pad;

(d) a mandrel adapted to have expended reversed backing tape wrapped therearound;

(e) a gear associated with said mandrel and having a gear cog; and, (f) a pawl;

wherein when said lever press pad is depressed first said gear is rotated turning said mandrel to draw said string of said stamps string through said feed channel, thereby, incrementally dispensing said stamps and automatically peeling off said backing tape; second, prior to said lever press pad reaching a bottom of a press pad stop point, said pawl drops into a gear cog to prevent reversing of said gear and said mandrel; and, third, said brake pad coupled to said lever press pad presses on said string in said feed channel locking said string in place.

17. The hand held stamp dispenser and applicator of claim 16, wherein said body comprises a side plate having a clock, a thermometer, or logo coupled thereto.

18. The hand held stamp dispenser and applicator of claim 16, further comprising a press roll assembly having a roller wherein when said stamp is applied to said envelope or said package, said stamp is pressed by said roller.

19. The hand held stamp dispenser and applicator of claim 16, further comprising a tongue leader which is attached to said mandrel via a mandrel slot and wherein said tongue leader is adapted to be joined to said backing tape.

20. The hand held stamp dispenser and applicator of claim 16, further comprising a handle coupled to said body.

* * * * *